United States Patent [19]

Rudolph et al.

[11] 4,165,970

[45] Aug. 28, 1979

[54] PROCESS AND APPARATUS FOR GASIFYING GRANULAR COAL UNDER SUPERATMOSPHERIC PRESSURE

[75] Inventors: Paul Rudolph, Bad Homburg; Paul Becker, Eschborn, both of Fed. Rep. of Germany

[73] Assignee: Metallgesellschaft Aktiengesellschaft, Frankfurt am Main, Fed. Rep. of Germany

[21] Appl. No.: 931,044

[22] Filed: Aug. 4, 1978

[30] Foreign Application Priority Data

Aug. 16, 1977 [DE] Fed. Rep. of Germany ..... 2736687

[51] Int. Cl.[2] ..... C10J 3/20

[52] U.S. Cl. ..... 48/73; 48/77; 48/87; 48/202; 110/229

[58] Field of Search ..... 48/68, 66, 67, 76, 77, 48/62 R, 73, 63, 87, 210, 202, 197 R, DIG. 2; 110/229, 230

[56] References Cited

U.S. PATENT DOCUMENTS

| | | | |
|---|---|---|---|
| 2,204,001 | 6/1940 | Radtke | 48/66 |
| 2,925,334 | 2/1960 | Henze et al. | 48/62 R |
| 4,002,438 | 1/1977 | Fleming | 48/76 |

*Primary Examiner*—Richard V. Fisher
*Assistant Examiner*—George C. Yeung
*Attorney, Agent, or Firm*—Sprung, Felfe, Horn, Lynch & Kramer

[57] ABSTRACT

An improvement in a known process and apparatus for gasifying coal with water vapor and oxygen under pressure and at elevated temperature wherein coal is dropped onto a grate within a reactor supplied with gasifying agent from below, product gas being withdrawn above. In accordance with the invention an annular wall depends from the reactor top to form an annular gas space through which product gas is withdrawn. The annular space surrounds the top of the coal bed so the coal is preheated thereby. The wall is provided with apertures so that at least 20% of the product gas enters the annular space by traversing that part of the coal bed surrounded by the wall. This results in reduced product gas velocity and entrainment of coal dust.

5 Claims, 2 Drawing Figures

Figure 1:
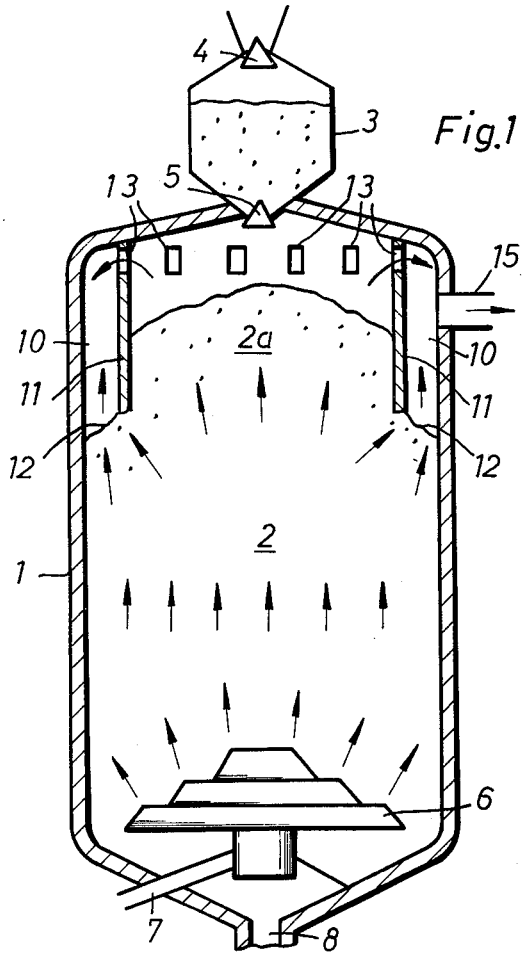

PROCESS AND APPARATUS FOR GASIFYING GRANULAR COAL UNDER SUPERATMOSPHERIC PRESSURE

This invention relates to a process of gasifying granular coal under a pressure of about 10 to 100 bars in a reactor in which the coal constitutes a fixed bed, wherein gasifying agents consisting of water vapor and a gas which contains free oxygen are fed into the lower portion of the fixed bed and product gas is withdrawn from the reactor through a product gas discharge conduit, which communicates with an annular space disposed behind a shielding wall which confines the upper portion of the coal bed.

The gasification of granular coal under superatmospheric pressure has been known for a long time. Known processes have been described in Opened German Specifications 23 52 900, 23 46 833, and in Printed German Application 26 04 383 and in the corresponding U.S. Pat. Nos. 3,902,872; 3,937,620; and 4,033,730. In the known reactors, granular coal is charged from above onto a fixed bed of coal, which gradually subsides. The gasifying agents are caused to flow countercurrent to the coal and are usually distributed in the coal bed from a rotary grate, which is disposed at the lower end of the reactor. The product gas formed by the gasification contains hydrogen, oxides of carbon, hydrocarbons which are gaseous or liquid at normal temperatures, water vapor and coal dust, and is withdrawn from the reactor at temperatures of about 300° to 800° C.

It is an object of the invention to improve known processes in such a manner that the rate at which dust is entrained by the product gas is minimized. In the process described hereinabove, this is accomplished according to the invention in that part of the product gas leaving the coal bed enters the annular space from below and another part of the product gas in an amount of at least about 20% of the entire product gas is caused to enter the annular space from the space above the coal bed portion confined by the shielding wall.

Owing to the division of the product gas discharged from the coal bed, the velocity of flow of the gas in the coal bed adjacent to the annular space does not exhibit the excessively high rise which has been observed in known processes and reactors. Besides, the fresh coal which has been charged onto the coal bed is contacted by the product gas in the upper portion of the coal bed so that the coal is more or less heated. Such heating of the coal may result in drying or, in case of strong heating, to a partial dry distillation at temperatures of about 300° to 600° C. A certain segregation of coarse and fine particles of coal in the upper portion of the coal bed also promotes a decrease of the dust discharge rate.

The process described hereinabove is carried out in a reactor which is designed in accordance with the invention in which the annular space is accessible at ist lower end to product gas from the coal bed and the shielding wall is formed above the coal bed with apertures for the passage of gas. These apertures ensure that the uppermost portion of the coal bed is traversed by the hot product gas.

The diameter of the shielding wall is suitably about 0.7 to 0.9 time the inside diameter of the reactor. In that case the annular space which does not contain coal to be gasified is sufficiently large to ensure that the collecting product gas flows at a low velocity.

The process according to the invention in conjunction with the design of the reactor eliminate the need for coal-distributing means in the pressure chamber of the reactor. Such distributing means rotating on a vertical axis have been described in Opened German Specification 23 52 900 (and the corresponding U.S. Pat. No. 3,902,872). It is possible, however, to use stirring arms which revolve in the coal bed. Such stirring arms are shown in Printed German Publication 23 53 241 and the corresponding U.S. Pat. No. 3,951,616.

Figure 2:
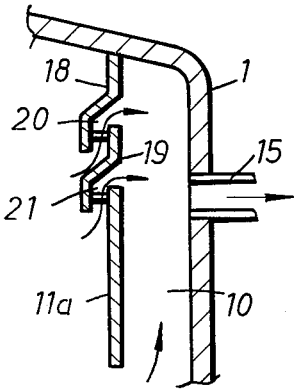

Embodiments of the process according to the invention and of the reactor for carrying out the process will be explained with reference to the drawing, in which FIG. 1 is a diagrammatic longitudinal sectional view showing a reactor for pressure gasification and FIG. 2 shows a design which may be adopted for the shielding wall of the reactor shown in FIG. 1.

The reactor for pressure gasification shown in FIG. 1 comprises a housing 1, which may be provided with a brick lining or with a cooling water jacket. A large part of the housing is filled with granular coal which is to be gasified and which constitutes a fixed bed 2. The reactor is charged through a coal lock chamber 3, which is provided with valves 4 and 5, which are periodically opened and closed. The coal to be gasified has particle sizes in the range of about 2 to 60 mm.

A rotary grate 6 is provided at the lower end of the reactor and can be rotated on a vertical axis by means which are not shown in detail. The gasifying agents consisting of water vapor and of a gas which contains free oxygen are distributed into the coal bed 2 from the rotary grate 6. The gasifying agents are fed to the rotary grate from the outside through a conduit 7.

Through an ash outlet 8 provided below the rotary grate 6, the ash falls into an ash lock chamber, not shown.

In the drawing, the arrows indicate diagrammatically the directions of gas flow in the reactor. The gases which flow through the coal bed countercurrent thereto are first collected in an annular space 10 disposed between the housing 1 and a cylindrical shielding wall 11. Gases can flow from the coal bed 2 into the annular space 10 at its lower end 12, where the annular space is open. Above the coal bed 2, the shielding wall 11 has a series of apertures 13, through which product gas can flow into the annular space from the upper portion *2a* of the coal bed. That upper portion *2a* is confined by the shielding wall 11. That part of the product gas which comes from the upper portion *2a* of the coal bed and enters the annular space 10 through the apertures 13 amounts to at least 20% and preferably about 30 to 70% of the entire product gas which is produced. The entire product gas leaves the annular space 10 through the exhaust conduit 15 and is cooled and purified by known means, which are not shown.

Granular coal, which may include brown coal and has particle sizes in the range from 2 to 60 mm, is charged into the reactor from the lock chamber 3. Fesh coal which has been charged is usually distributed in the upper portion *2a* of the coal bed in such a manner that the coarser particles of the coal preferentially accumulate near the shielding wall 11 because they can trickle more easily. On the other hand, the finer particles of coal become enriched in the central portion of the bed. As a result, the outer portions of the coal bed present a smaller resistance to the flow of the gas and are thus more highly permeable to gas. The distribution of the different particle sizes in the bed tends to decrease the rate at which dust is entrained by the product gas leaving the reactor. This decrease is also promoted by the fact that the product gas enters the annular chamber 10 not only at its lower end but part of the product gas is discharged through the openings 13.

Owing to the product gas temperatures of about 300° to 800° C. measured in the discharge conduit 15, fresh coal which has been charged to the upper portion 2*a* of the coal bed can be quickly dried and heated at the same time. By that heating, layers of coal in the upper portion 2*a* of the bed are subjected to a dry distillation, which becomes more intense as the coal subsides in the reactor. The withdrawel of product gas through the openings 13 thus improves the utilization of the reactor volume for the gasification of coal and considerably contributes to the performance.

FIG. 2 is an enlarged view showing the right upper portion of the reactor of FIG. 1 with a shielding wall 11*a* which is modified relative to FIG. 1. The shielding wall 11*a* of FIG. 2 is also cylindrical but differs from that of FIG. 1 in that it is provided with louvers. The angled wall portions 18 and 19 define annular slots 20 and 21, through which the gas can flow out of the upper end of the coal bed into the annular space 10. It is apparent that the slots 20 and 21 of FIG. 2 replace the apertures 13 in the shielding wall of FIG. 1. The arrows in FIG. 2 indicate also the directions in which the gases flow into the annular space 10. The angled annular wall portion 19 of the shielding wall 11*a* in FIG. 2 is connected by individual webs to the adjacent parts of the shielding wall 1*a*.

The process is described further in the following illustrative example:

EXAMPLE

A reactor which is of the kind shown in FIG. 1 and used for pressure gasification has an inside diameter of 4 meters and an inside height of 3.50 meters above the rotary grate. The shielding wall 11 has a height of 2 meters and a diameter of 3.10 meters. The shielding wall 11 is provided with forty apertures 13, each of which has an area of 0.1 $m^2$. The apertures are arranged in two rows.

Coal having a particle size of 2 to 60 mm is fed to the reactor at a rate of 29 tons per hour (calculated as dry, ashfree coal). A mixture of gasifying agents are fed into the rotary grate 6 at a rate of 51 tons of water vapor and 8500 standard $m^3$ of oxygen per hour and are distributed from the rotary grate 6 into the fixed bed. Raw gas is withdrawn from the reactor through the exhaust conduit 15 at a rate of 60,000 standard $m^3$ per hour (calculated as dry gas) further containing 40,000 standard $m^3$ of water vapor, 3000 kg tar vapor, and 200 kg solids, particularly coal dust, per hour. 30% of the entire product gas enter the annular space 10 through the openings 13.

The total area of the apertures in the shielding wall will depend upon the conditions of gasification and the apertures can even be provided with means for adjusting their size.

It will be appreciated that the instant specification and examples are set forth by way of illustration and not limitation, and that various modifications and changes may be made without departing from the spirit and scope of the present invention.

What we claim is:

1. In a reactor for gasifying granular coal including a grate for holding a fixed bed of coal, means for introducing a gasifying agent to the bottom of the bed of coal, conduit means for withdrawing coal residue from the bottom of the coal bed, and means for withdrawing product gas from adjacent the top of the coal bed, the improvement which comprises a shielding wall adjacent the top of the reactor and terminating above the grate so as to define with the reactor an annular space open from below and communicating with said conduit means, the annular space surrounding the top of the coal bed, said shielding wall being provided with apertures whereby part of the product gas from the upper portion of the bed which is surrounded by the annular space can enter such annular space through said apertures.

2. An apparatus according to claim 1, wherein the diameter of the shielding wall is about 0.7 to 0.9 time the inside diameter of the reactor.

3. In a process of gasifying granular coal with a particle size in the range of about 2 to 60 mm under a pressure of about 10 to 100 bars in a reactor in which the coal constitutes a fixed bed, wherein gasifying agents comprising water vapor and a gas which contains free oxygen are fed into the lower portion of the fixed bed, and product gas is withdrawn from the reactor through a product gas discharge conduit which communicates with an annular space disposed behind a shielding wall which confines the upper portion of the coal bed, the improvement which comprises subdividing the product gas within the coal bed so that part enters the annular space from below and another part of the product gas in an amount of at least 20% up to about 70% of the entire product gas enters the annular space from the space above the upper portion of the coal bed confined by the shielding wall through apertures in said shielding wall.

4. A process according to claim 3, wherein said portion of the coal bed which is confined by the shielding wall is heated by product gas.

5. A process according to claim 4, wherein at least part of the coal in said portion of the coal bed which is confined by the shielding wall is heated to a temperature of about 300° to 600° C. and subjected to dry distillation by product gas.

* * * * *